US010138031B2

(12) United States Patent
Del Rosario Roy et al.

(10) Patent No.: US 10,138,031 B2
(45) Date of Patent: Nov. 27, 2018

(54) PIVOTING COVER FOR A CONTAINER

(71) Applicant: IPL INC., St-Damien (CA)

(72) Inventors: Daisy Del Rosario Roy, Lévis (CA); Stéphane Mercier, St-Damien (CA); Jean-Gabriel Labrecque, St-Damien-de-Buckland (CA)

(73) Assignee: IPL INC., St-Damien (CA)

( * ) Notice: Subject to any disclaimer, the term of this patent is extended or adjusted under 35 U.S.C. 154(b) by 0 days.

(21) Appl. No.: 15/460,805

(22) Filed: Mar. 16, 2017

(65) Prior Publication Data

US 2017/0267419 A1 Sep. 21, 2017

Related U.S. Application Data

(60) Provisional application No. 62/309,994, filed on Mar. 18, 2016.

(51) Int. Cl.

| | |
|---|---|
| ***B65D 43/16*** | (2006.01) |
| ***B65D 21/02*** | (2006.01) |
| ***B65D 43/24*** | (2006.01) |
| ***B65D 55/02*** | (2006.01) |
| ***B65D 43/02*** | (2006.01) |

(52) U.S. Cl.

CPC ..... *B65D 43/161* (2013.01); *B65D 21/0209* (2013.01); *B65D 43/0235* (2013.01); *B65D 43/24* (2013.01); *B65D 55/02* (2013.01); *B65D 2543/0025* (2013.01); *B65D 2543/00027* (2013.01); *B65D 2543/00194* (2013.01); *B65D 2543/00222* (2013.01); *B65D 2543/00296* (2013.01); *B65D 2543/00379* (2013.01)

(58) Field of Classification Search

CPC ..... B65D 43/161; B65D 43/16; B65D 43/24; B65D 43/0235; B65D 43/02; B65D 55/02; B65D 21/0212; B65D 21/0209; B65D 21/0235; B65D 17/24; B65D 17/165; B65D 17/163; B65D 17/166; B65D 17/161; B65D 17/16; B65D 51/18; B65D 43/169; B65D 45/16

USPC ..... 220/270, 269, 268, 266, 265, 826, 810, 220/832, 831, 380, 254.3, 254.2, 254.6, 220/254.7, 259.2, 259.1, 324, 315; 206/508, 512, 509, 504

See application file for complete search history.

(56) References Cited

U.S. PATENT DOCUMENTS

| | | | | |
|---|---|---|---|---|
| 3,338,468 A * | 8/1967 | Wilson | B65D 21/0219 206/508 |
| 4,369,901 A * | 1/1983 | Hidding | B65D 47/0852 222/142.7 |
| 5,617,968 A | 4/1997 | Luburic | |

(Continued)

FOREIGN PATENT DOCUMENTS

| | | |
|---|---|---|
| CA | 2144275 C | 9/1995 |
| CA | 2379436 | 10/2002 |

(Continued)

*Primary Examiner* — Robert J Hicks

(74) *Attorney, Agent, or Firm* — Gwendoline Bruneau

(57) ABSTRACT

A cover for a container, comprising a central web comprising a first web part and a second web part; and a hinge pivotally connecting the first and second web parts; wherein a first one of the web parts comprises at least one rib on an edge thereof facing the hinge, and a second one of the web parts comprises at least one corresponding recess on an edge thereof facing the hinge.

20 Claims, 7 Drawing Sheets

(56) References Cited

U.S. PATENT DOCUMENTS

| | | | | |
|---|---|---|---|---|
| 7,134,567 | B2 | 11/2006 | Luburic | |
| 7,165,695 | B2 | 1/2007 | Choi | |
| 7,743,951 | B2 | 6/2010 | Vogel et al. | |
| 7,784,635 | B2 | 8/2010 | Luburic | |
| 7,837,052 | B2 | 11/2010 | Luburic | |
| 7,909,212 | B2 | 3/2011 | Parve | |
| 8,235,238 | B2 | 8/2012 | Luburic | |
| 8,448,804 | B2 | 5/2013 | Luburic | |
| 8,517,212 | B2 * | 8/2013 | Antal, Sr. ..... | B65D 47/0847 220/254.3 |
| 8,839,975 | B2 | 9/2014 | Luburic | |
| D728,240 | S | 5/2015 | Luburic | |
| 2002/0148834 | A1 | 10/2002 | Luburic | |
| 2002/0148846 | A1 | 10/2002 | Luburic | |
| 2003/0189048 | A1 | 10/2003 | Luburic | |
| 2004/0084465 | A1 | 5/2004 | Luburic | |
| 2008/0083768 | A1 | 4/2008 | Luburic | |
| 2009/0032534 | A1 | 2/2009 | Luburic | |
| 2011/0017740 | A1 | 1/2011 | Luburic | |
| 2013/0186897 | A1 | 7/2013 | Luburic | |
| 2015/0129593 | A1 | 5/2015 | Luburic | |

FOREIGN PATENT DOCUMENTS

| | | |
|---|---|---|
| CA | 2800172 | 4/2006 |
| CA | 2114805 | 12/2006 |
| CA | 2760243 | 2/2011 |
| CA | 2764976 | 7/2013 |
| CA | 2425492 | 9/2013 |
| CA | 2522230 | 8/2014 |
| CA | 2800164 | 1/2015 |
| CA | 2562328 | 5/2015 |
| CA | 2868491 | 5/2015 |
| WO | WO 01/56899 A1 | 8/2001 |

* cited by examiner

PIVOTING COVER FOR A CONTAINER

CROSS REFERENCE TO RELATED APPLICATIONS

This application claims benefit of U.S. provisional application Ser. No. 62/309,994, filed on Mar. 18, 2016. All documents above are incorporated herein in their entirety by reference.

FIELD OF THE INVENTION

The present invention relates to containers. More specifically, the present invention is concerned with a cover for a container.

SUMMARY OF THE INVENTION

More specifically, in accordance with the present invention, there is provided a cover for a container, comprising a central web comprising a first web part and a second web part; and a hinge pivotally connecting the first and second web parts; wherein a first one of the web parts comprises at least one rib on an edge thereof facing the hinge, and a second one of the web parts comprises at least one corresponding recess on an edge thereof facing the hinge.

There is further provided a container and cover combination, comprising a container with an opening and a cover adapted to close the opening of the container in a closed position thereof, wherein the cover comprises a central web comprising a first web part and a second web part and a hinge pivotally connecting the first and second web parts; a first one of the web parts comprising at least one rib on an edge thereof facing the hinge, and a second one of the web parts comprising at least one corresponding recess on an edge thereof facing the hinge; and wherein in the closed position of the cover, the first and second web parts lay generally flat on a respective side of the hinge, with the rib and the back wall projecting up from respective outer surfaces of the first and second web parts; the first web part being pivotable from the closed position to an open position allowing access to an inside of the container by pivoting said first web part about said hinge towards said second web part, until said rib engages said recess.

There is further provided a stackable container, comprising a body having an opening for access to an inside of the container, and a cover, adapted to cover at least part of the opening of the container; wherein the cover comprises a central web comprising a first web part and a second web part and a hinge pivotally connecting the first and second web parts; a first one of the first and second web parts comprising at least one rib of a first height on an edge thereof facing the hinge, and a second one of the first and second web parts comprising at least one corresponding recess on an edge thereof facing the hinge, the recess being separated from a remaining web part of the second one of the first and second web parts by a back wall of a second height; and the cover comprising a platform at least at diagonally opposed corners thereof, the platform having a third height at least equal to a larger one of the first and second heights.

Other objects, advantages and features of the present invention will become more apparent upon reading of the following non-restrictive description of specific embodiments thereof, given by way of example only with reference to the accompanying drawings.

DESCRIPTION OF EMBODIMENTS OF THE INVENTION

Figure 1:
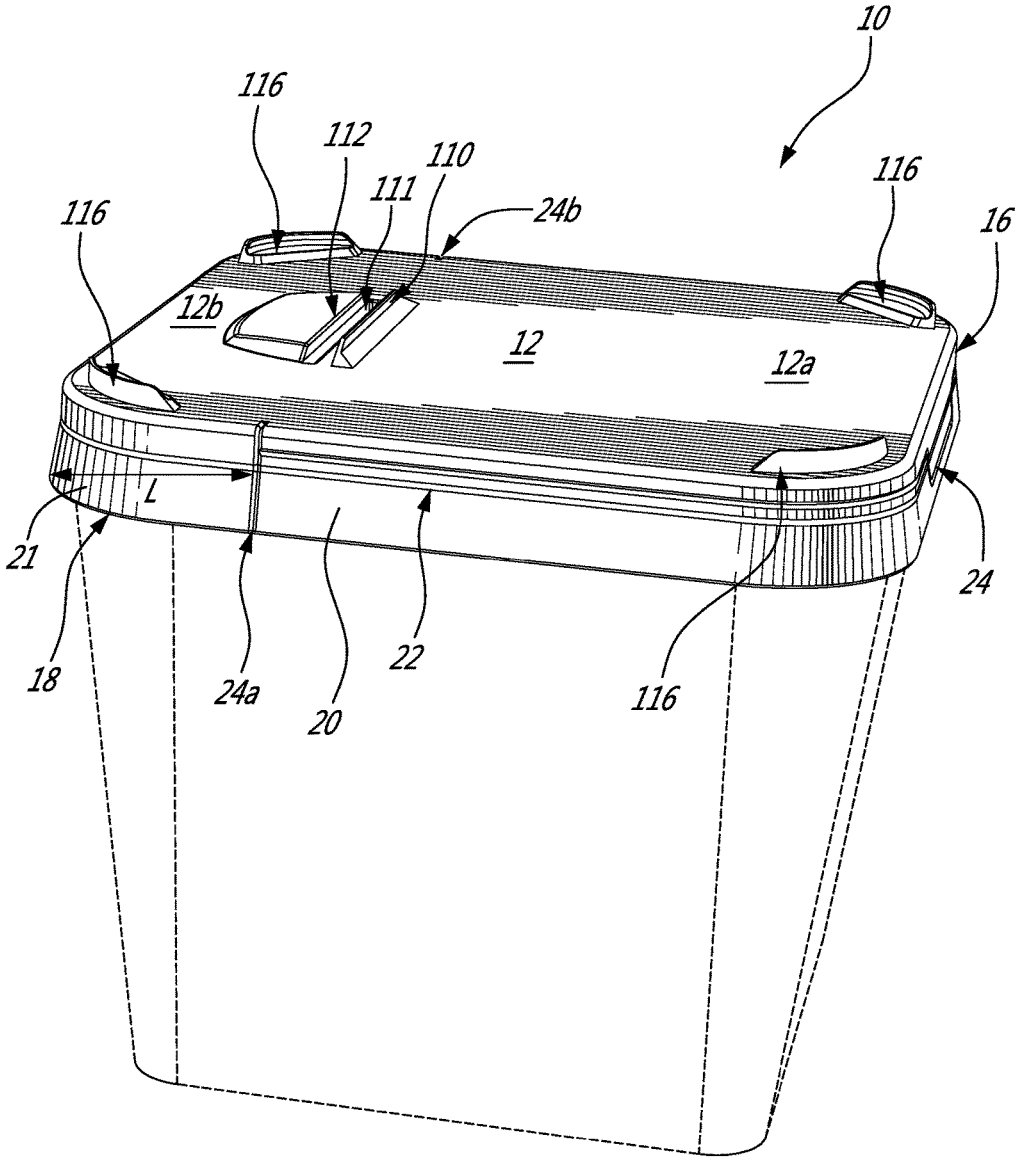
FIG. 1 is a side perspective view of a cover according to an embodiment of an aspect of the present invention, in a closed position.
Figure 3A:
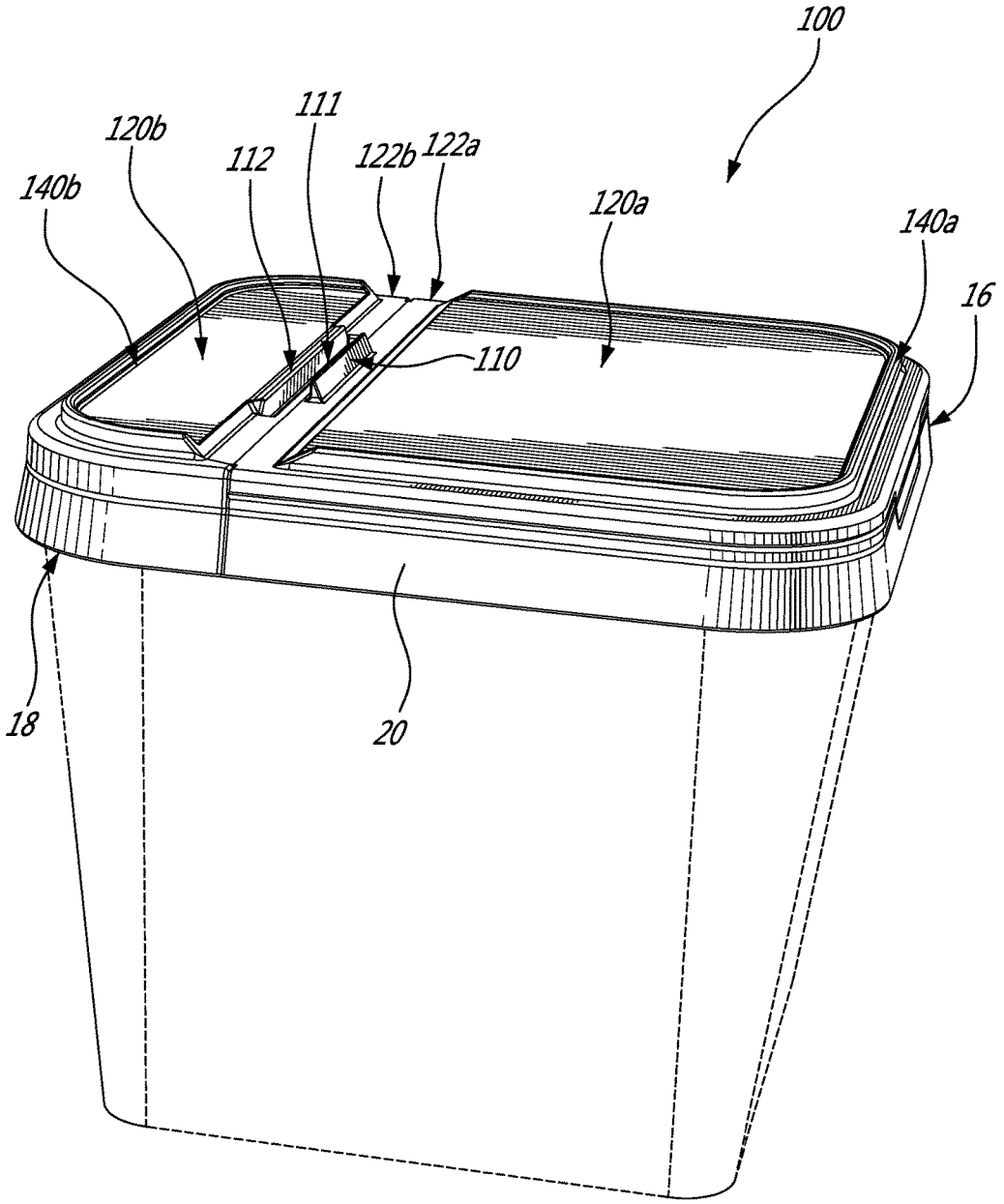
FIG. 3A is a side perspective view of a cover according to an embodiment of an aspect of the present invention, in a closed position.

FIGS. 1 and 3 show covers 10 and 100 of a substantially square or rectangle shape adapted to be mounted on a container (shown in stipple lines in FIGS. 1, 3, 4 for example) of a corresponding shape to cover an opening of the container. Other shapes may be contemplated, such as round or oval shapes for example.

The cover 10 generally comprises a central web 12 extending into a circumferential flange 16 and a skirt 18 dependent thereon and generally perpendicular to the central web 12, and configured to extend around an outside of the opening of the container as known in the art.

The central web 12 comprises a first part 12*a* and a second part 12*b* pivotally connected by a live hinge 60 as best seen in FIGS. 2, integral with the cover 10 on the bottom surface of the cover 10. The first web part 12*a* has a first thickness, and the second web part 12*b* has a second thickness, the first and second thicknesses may be the same or different. In FIGS. 2, both parts 12, 12*b* are illustrated with a same thickness.

The live hinge 60 may be a thinning of the material of the cover 10, i.e. a line part of the cover extending from one side to the opposite side of the cover and having a third thickness smaller than at least one of the thickness of the parts 12*a* and 12*b*, as schematically shown in FIGS. 2 for example.

Alternatively, the live hinge 60 may be a line protruding either inwards or outwards, in a step-like manner for example, from the base surface of the parts 12*a* and 12*b*, for example.

In the illustrated embodiment, the skirt 18 comprises a tear strip 20 defined by an upper score line 22 and connecting score lines 24*a*, 24*b*, the upper score line 22 running along a length of the circumference of the cover, between the flange 16 and the depending skirt 18, from one connecting score line 24*a* to an opposite connecting score line 24*b*.

Figure 3B:
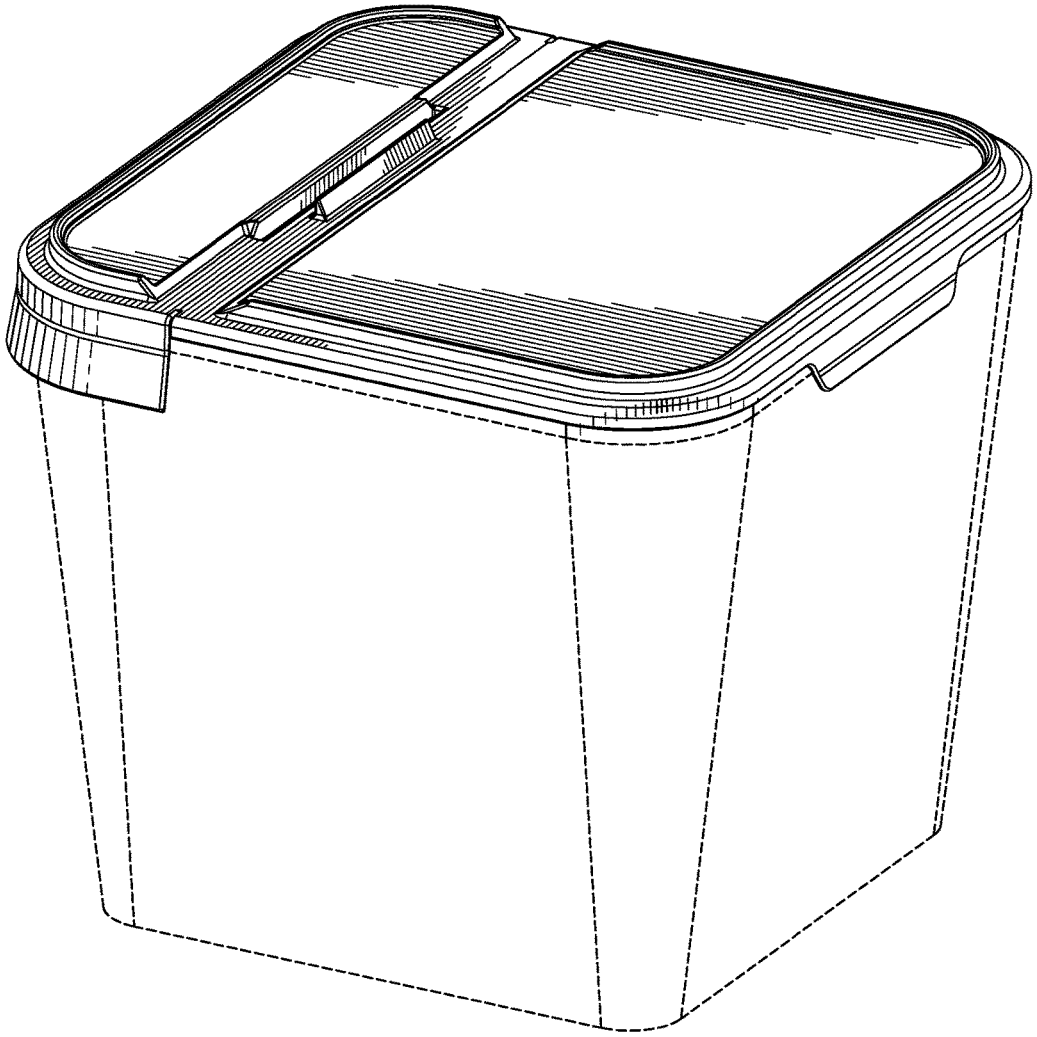
FIG. 3B is a side perspective view of the cover of FIG. 3A after removal of a of tear strip thereof, in a closed position.
Figure 4:
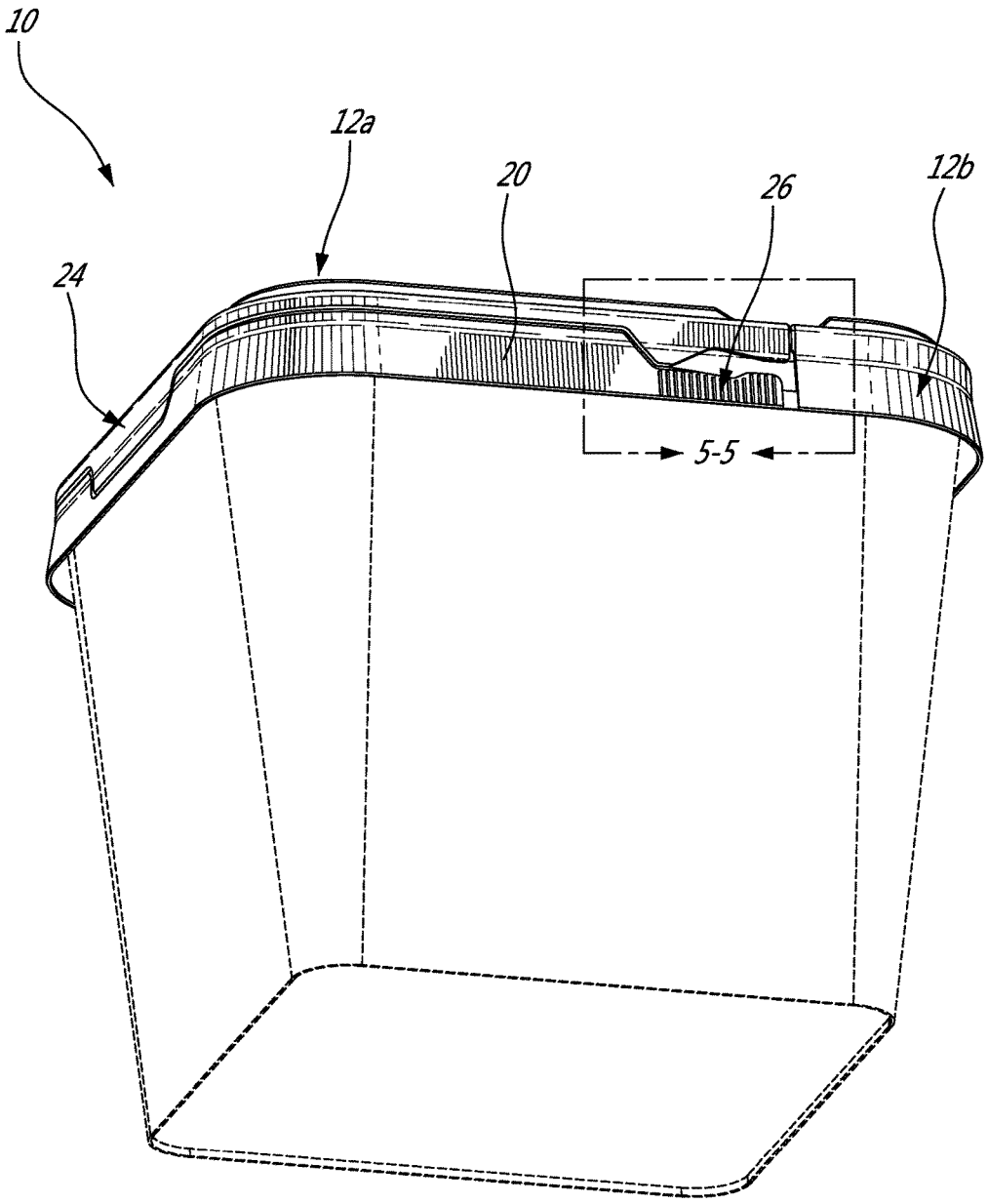
FIG. 4 is a bottom perspective view of a cover according to an embodiment of an aspect of the present invention, in a closed position.

The tear strip 20 forms a portion of the skirt 18 that is partially removable from the cover 10, i.e. from the first score line 24*a* on one side of the cover 10 to the second score line 24*b* on the opposite side of the cover 10, leaving a tab 24 on the cover 10 and a remaining part 21 of the skirt 18 at a rear end of the cover 10 between the first score line 24*a* on one side of the cover 10 to the second score line 24*b* on the opposite side of the cover 10 when removed, as shown for example in FIG. 3B.

Figure 2B:
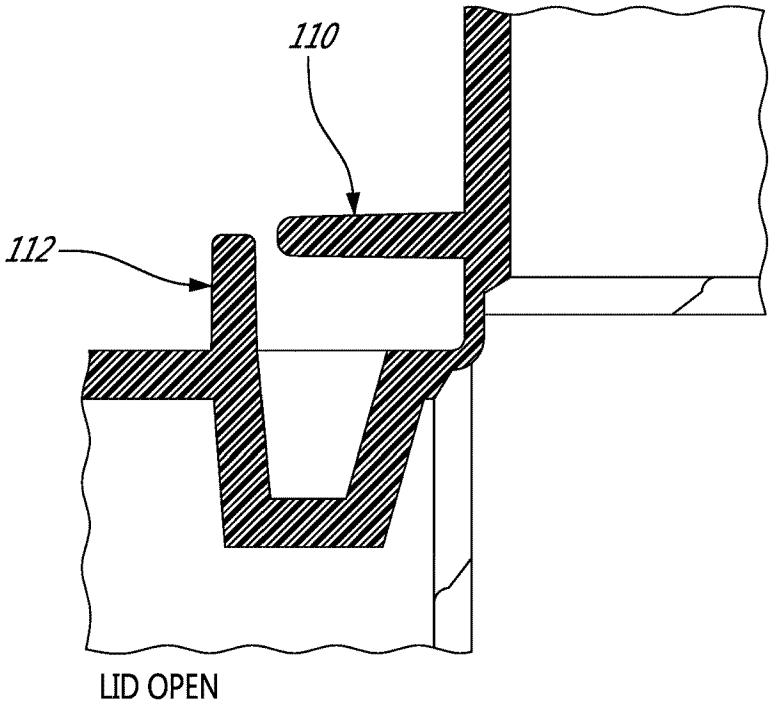
FIG. 2B schematically shows a first open position of a cover according to an embodiment of an aspect of the present invention.
Figure 2A:
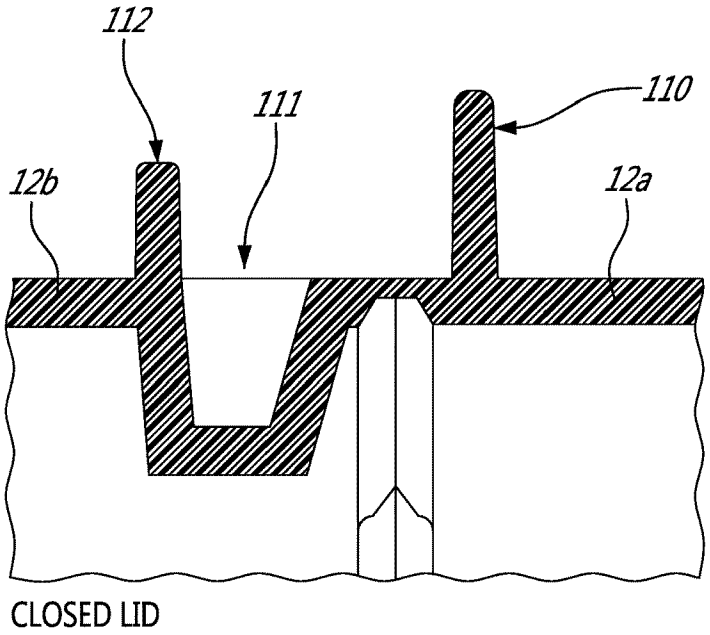
FIG. 2A schematically shows a closed position of a cover according to an embodiment of an aspect of the present invention.
Figure 2D:
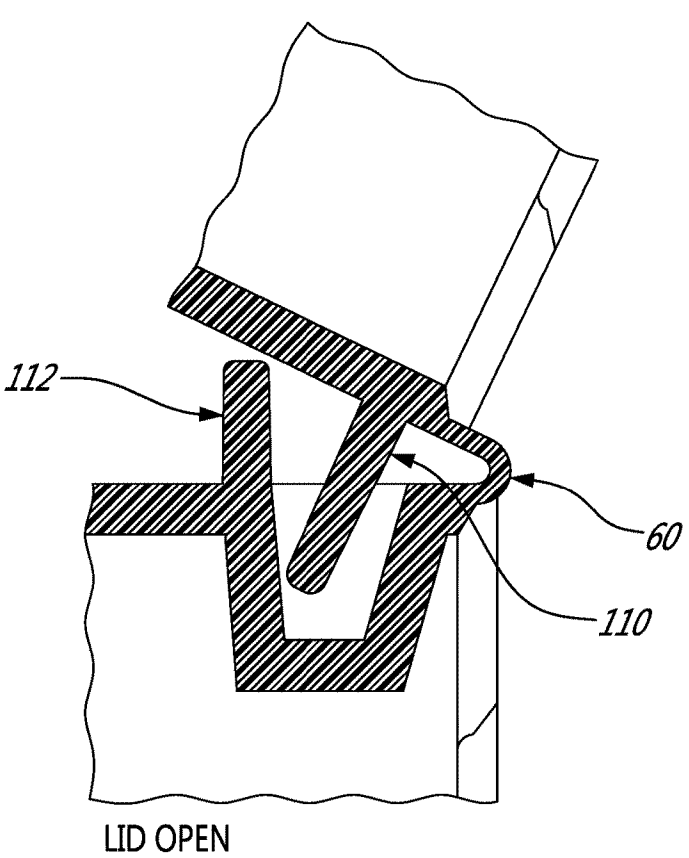
FIG. 2D schematically shows a locked open position of a cover according to an embodiment of an aspect of the present invention.
Figure 2C:
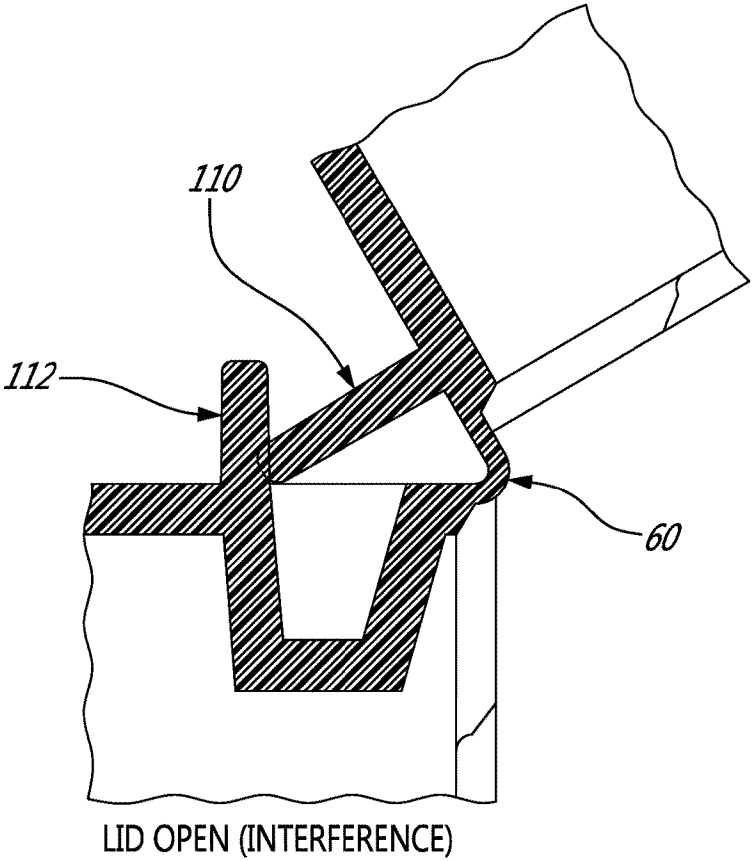
FIG. 2C schematically shows a second open position of a cover according to an embodiment of an aspect of the present invention.
Figure 5:
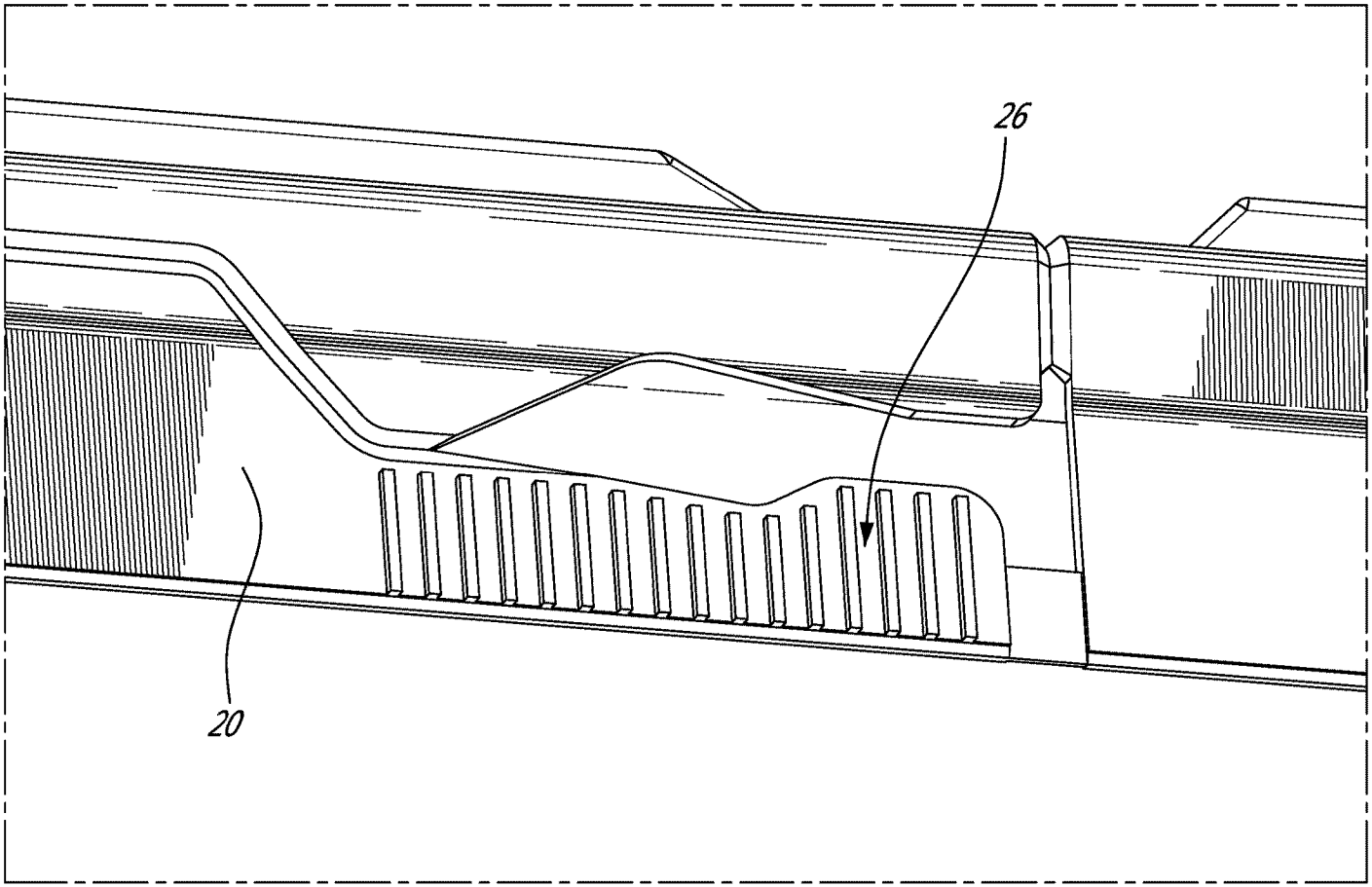
FIG. 5 shows details of FIG. 4.

A user typically grabs an end 26 of the tear strip 20 to initiate tearing of the tear strip 20 and to remove the tear strip 20 from the cover 10 (see FIGS. 4 and 5 for example), and can then lift up the part 12*a* of the cover 10 from its closed position on the opening of the container (FIG. 2A), to an open position, by grabbing the tab 24 and lifting it up for example, by movement about the live hinge 60 (FIGS. 2B-2D).

As mentioned hereinabove, the part 12*b* of the cover 10, which remains flat on the opening of the container when the part 12*a* is lifted up from the opening of the container, and the part 12*a*, may have different thicknesses.

In FIGS. 1 and 3, the hinge 60 is shown positioned at about ⅓ of the side length of the cover 10 from its rear edge (see distance L in FIG. 1). The hinge 60 can be positioned at any desired distance from the rear edge of the cover 10, depending of the target size of the opening provided when the part 12*a* of the lid is lifted up from the opening of the container as described hereinabove.

In FIG. 1, the parts 12*a* and 12*b* of the cover 10 on each side of the living hinge 60 are on a same level and generally flat. Alternatively, one or both parts 12*a* and 12*b* of the cover 10 can be concave or convex, i.e. with a given curvature either upwards or downwards when seen from the outer surface of the cover 10.

At least one rib 110 extends along at least part of the width of the cover, typically at a center thereof in the case of a single one as illustrated in FIG. 3 for example, on an edge of the first part 12*a* facing the living hinge 60, at a distance therefrom. The facing edge of the second part 12*b* on the opposite side of the living hinge 60 is provided with a corresponding recess 111 separated from the remaining of the part 12B by a corresponding wall 112. The wall 112 has substantially the same height above the outer surface of the cover than the height of the rib 110 above the outer surface of the cover.

As best seen in FIGS. 1 and 2A, in the closed position of the cover 10, the two parts 12*a*, 12*b* lay on both sides of the living hinge 60, so as to cover the opening of the container and prevent access to a content of the inside of the container for example, with the rib 110 and the back wall 112 projecting up from their respective top surfaces. As shown in FIG. 1, corner supports 116 may be provided at each corner, or at least at diagonally opposed corners of the cover 10, of a height from the top surface of the cover at least the height of the wall 112 and the rib 110, to allow stacking a top container.

A user, after removal of the tear strip 20 from the cover 10 as described hereinabove, can lift up the part 12*a* of the cover 10 from the closed position as illustrated for example FIG. 2A, to an open position as shown in FIG. 2B in which the part 12*a* of the cover is generally at 90 degrees from the part 12*b* thereof. The part 12*a* may be further tilted back until the top edge of the rib 110 contacts the back wall 112 (FIG. 2C), and is thus made to slide down the recess 111 by engagement with the back wall 112, thereby locking the part 12*a* of the cover 10 in an open locked position where the part 12*a* is generally at an angle larger to 90 degrees (FIG. 2D) from its position in the closed position (FIG. 2A). To pivot the part 12*a* back to an unlocked open position (FIG. 2B) or to the closed position (FIG. 2A), the user must pull on the part 12*a* (i.e. to the right handside in FIG. 2D) so as to disengage the rib 110 from the recess 111.

FIG. 3 illustrate a cover 100 according to another embodiment of an aspect of the present invention. The first part and the second part of the cover 100 each comprises a platform 120*a*, 120*b* respectively standing above a base surface 122*a* and 122*b* of the first and second parts of the cover 100 respectively, not only at corners thereof like the corner supports 116 described hereinabove in relation to FIG. 1 for example. The base surface 122*a* supports the rib 110, and the base surface 122*b* supports the wall 112, with the recess 111 therebetween as described hereinabove in relation to FIG. 1.

The platforms 120*a*, 120*b* protrude above the base surfaces 122*a*, 122*b* and generally cover the surface of each part 12*a*, 12*b* of the cover 100 generally up to the circumferential flange 16 on three sides thereof.

The height of the platforms 120*a*, 120*b* above the base surfaces 122*a*, 122*b* may be the same as the height of the rib 110 and the wall 112 above the top surface of the cover so as to allow stacking an upper container. Alternatively, a circumferential wall 140*a*, 140*b* respectively, or parts thereof, may be added up to the height of the platforms 120*a*, 120*b* from the top surface of the cover, i.e. from the top surface of the base regions 122*a*, 122*b*, to reach the height of the rib 110 and the wall 112 above the top surface of the cover so as to allow stacking an upper container.

FIG. 2 applies as described hereinabove to the embodiment illustrated in FIG. 3.

In all embodiments, the tear strip 20 may operate as tamper-indicating evidence.

Typically, the cover is injected molded, in polypropylene, for its stiffness and ability to sustain repeated flexions without breaking, or polyethylene for example.

The illustrations hereinabove show to a container having a top opening. However, as people in the art will appreciate, a cover according to the present invention may be used in combination with a container having an opening in any side thereof, for example to cover a side opening.

The scope of the claims should not be limited by the embodiments set forth in the examples, but should be given the broadest interpretation consistent with the description as a whole.

The invention claimed is:

1. A cover for a container, the cover comprising:

a central web comprising a first web part having a base surface and a second web part having a base surface; and a hinge pivotally connecting said first and second web parts;

wherein, on a first side of said hinge, a first one of said web parts comprises at least one rib extending along at least a part of a width of said first web part on an edge of said first web part facing the hinge, and, on a second side of said hinge, a second one of said web parts comprises at least one recess extending along at least a part of a width of said second web part on an edge of said second web part facing the hinge, said second web part further comprising a back wall separating said recess from a remaining portion of said second web part; said rib, said back wall and said recess being generally transverse to said base surface of their respective web parts; and wherein, in a closed position of the cover, the first and second web parts lay on a respective side of the hinge, with the rib and the back wall projecting up from said base surface of their respective web parts;

said first web part being pivotable from the closed position to an open position by lifting up the first web part and tilting the first web part, about said hinge, towards the second web part until a top edge of the rib contacts the back wall and is thus made to slide down the recess by engagement with the back wall.

2. The cover of claim 1, wherein said central web comprises a platform at least at diagonally opposed corners thereof.

3. The cover of claim 1, wherein each one of said first and second web parts comprises a platform on an outer surface thereof, standing above the respective base surface thereof.

4. The cover of claim 1, wherein:

in the closed position of the cover, the first and second web parts lay generally flat on a respective side of the hinge;

said first web part being pivotable from the closed position to the open position until the top edge of the rib contacts the back wall and is thus made to slide down the recess by engagement with the back wall in an open locked position of the cover; and said first web part being pivotable from said open locked position by disengaging said rib from said recess.

5. The cover of claim 1, wherein said first web part has a first thickness, said second web part has a second thickness, and said hinge is a line extending from one side to an opposite side of the cover, said line having a third thickness, said third thickness being inferior to at least one of said first thickness and said second thickness.

6. The cover of claim 1, wherein said hinge is a line extending from one side to an opposite side of the cover and protruding either inwards or outwards from at least one of the base surface of the first web part and the base surface of the second web part.

7. The cover of claim 1, wherein said central web extends into a circumferential flange and a skirt dependent from said circumferential flange and generally perpendicular to the central web.

8. The cover of claim 1, wherein said central web extends into a circumferential flange and a skirt dependent from said circumferential flange and generally perpendicular to the central web, a length of said skirt along a circumference of at least one of said first and second web parts comprising a tear strip.

9. The cover of claim 1, wherein said central web extends into a circumferential flange and a skirt dependent from said circumferential flange and generally perpendicular to the central web, a length of said skirt along a circumference of at least one of said first and second web parts comprising a tear strip, said tear strip being defined by an upper score line and connecting score lines, the upper score line running along a length of the circumference of the cover, between the flange and the skirt, from a first connecting score line to an opposite connecting score line.

10. The cover of claim 1, wherein said first web part is one of: flat, convex and concave, and said second web part is one of: i) flat, ii) convex and iii) concave.

11. The cover of claim 1, wherein said central web extends into a circumferential flange and a skirt dependent from said circumferential flange and generally perpendicular to the central web, a length of said skirt along a circumference of a first one of said first and second web parts comprising a tear strip, said tear strip being defined by an upper score line and connecting score lines, the upper score line running along a length of the circumference of the cover, between the flange and the skirt, from a first connecting score line to an opposite connecting score line, said tear strip, when removed, leaving a tab on said first one of said first and second web parts and a length of said skirt on a second one of said first and second web parts.

12. The cover of claim 1, said cover being in one of: i) polypropylene and ii) polyethylene.

13. The cover of claim 1, wherein said at least one rib extends along at least part of the width of the cover, at a center of said width, aligned with said hinge.

14. A container and cover combination, comprising:

a container with an opening; and a cover adapted to close said opening of the container in a closed position thereof;

wherein said cover comprises a central web comprising a first web part and a second web part and a hinge pivotally connecting said first and second web parts;

wherein, on a first side of said hinge, a first one of said web parts comprising at least one rib on an edge thereof aligned with the hinge; on a second side of said hinge, a second one of said web parts comprising at least one corresponding recess on an edge thereof aligned with the hinge and a back wall aligned with the recess, said recess being separated from a remaining portion of said second web part by said back wall; said rib, said back wall and said recess being generally transverse to an outer surface of their respective web parts; and wherein:

in the closed position of the cover, the first and second web parts lay on a respective side of the hinge, with the rib and the back wall projecting up from the respective outer surfaces of the first and second web parts;

said first web part being pivotable from the closed position to an open position allowing access to an inside of the container by pivoting said first web part about said hinge towards said second web part, until a top edge of the rib contacts the back wall and is thus made to slide down the recess by engagement with the back wall.

15. The container and cover combination of claim 14, wherein said cover comprises a platform at least at diagonally opposed corners thereof.

16. The container and cover combination of claim 14, said central web extends into a circumferential flange and a skirt dependent from said circumferential flange, said skirt generally perpendicular to the central web and configured to extend around an outside of the opening of the container, a length of said skirt along a circumference of a first one of said first and second web parts comprising a tear strip, said tear strip being defined by an upper score line and connecting score lines, the upper score line running along a length of the circumference of the cover, between the flange and the skirt, from a first connecting score line to an opposite connecting score line, said tear strip, when removed, leaving a tab on said first one of said first and second web parts and a length of said skirt on a second one of said first and second web parts.

17. A stackable container, comprising a body having a top opening for access to an inside of the container, and a cover, adapted to cover at least part of said top opening of the container;

wherein said cover comprises a central web comprising a first web part and a second web part and a hinge pivotally connecting said first and second web parts; a first one of said first and second web parts comprising at least one rib of a first height extending along at least a part of a width of said first web part on an edge of said first web part facing the hinge on a first side of said hinge, and, on a second side of said hinge a second one of said first and second web parts comprising at least one corresponding recess extending along at least a part of a width of said second web part on an edge of said second web part facing the hinge, said recess being separated from a remaining web part of said second one of said first and second web parts by a back wall of a second height, said rib, said back wall and said recess being generally transverse to an outer surface of their respective web parts; and said cover comprising a platform at least at diagonally opposed corners thereof, said platform having a third height at least equal to a larger one of said first and second heights; and wherein, in a closed position of the cover, the first and second web parts lay on a respective side of the hinge, with the rib and the back wall projecting up from respective outer surfaces of the first and second web parts;

said first web part being pivotable from the closed position to an open position by lifting up the first web part and tilting it, about said hinge, towards the second web part until a top edge of the rib contacts the back wall and is thus made to slide down the recess by engagement with the back wall.

18. The stackable container of claim 17, wherein:

said first web part being pivotable from said open position by disengaging said rib from said recess.

19. The stackable container of claim 17, said central web extends into a circumferential flange and a skirt dependent from said circumferential flange, said skirt generally perpendicular to the central web and configured to extend around an outside of the opening of the container, a length of said skirt along a circumference of a first one of said first and second web parts comprising a tear strip, said tear strip being defined by an upper score line and connecting score lines, the upper score line running along a length of the circumference of the cover, between the flange and the skirt, from a first connecting score line to an opposite connecting score line, said tear strip, when removed, leaving a tab on said first of said first and second web parts and a length of said skirt on a second one of said first and second web parts.

20. The stackable container of claim 17, wherein said at least one rib extends along at least part of the width of the cover, at a center of said width, aligned with said hinge.

* * * * *